US012606351B2

(12) United States Patent
Morgan

(10) Patent No.: US 12,606,351 B2
(45) Date of Patent: Apr. 21, 2026

(54) TETHERED CLOSURE AND CONTAINER ASSEMBLY

(71) Applicant: Plastipak Packaging, Inc., Plymouth, MI (US)

(72) Inventor: Edward V. Morgan, Northville, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 17/121,474

(22) Filed: Dec. 14, 2020

(65) Prior Publication Data

US 2021/0362910 A1 Nov. 25, 2021

Related U.S. Application Data

(60) Provisional application No. 62/947,137, filed on Dec. 12, 2019.

(51) Int. Cl.
*B65D 41/34* (2006.01)
*B65D 55/16* (2006.01)

(52) U.S. Cl.
CPC ..... *B65D 41/3428* (2013.01); *B65D 55/16* (2013.01)

(58) Field of Classification Search
CPC ..... B65D 55/16; B65D 41/4328; B65D 41/3409; B65D 41/3428; B65D 41/3404; B65D 41/48; B65D 41/04
USPC ..... 215/243, 250–254
See application file for complete search history.

(56) References Cited

U.S. PATENT DOCUMENTS

| | | | | |
|---|---|---|---|---|
| 3,904,062 | A | 9/1975 | Grussen | |
| 4,043,475 | A | 8/1977 | Wheeler | |
| 4,394,918 | A * | 7/1983 | Grussen | B65D 41/3428 215/253 |
| 4,432,461 | A | 2/1984 | Mumford et al. | |
| 4,458,821 | A | 7/1984 | Ostrowsky | |
| 4,458,822 | A | 7/1984 | Ostrowsky | |
| 4,470,513 | A | 9/1984 | Ostrowsky | |
| 4,478,343 | A | 10/1984 | Ostrowsky | |
| 4,480,761 | A | 11/1984 | Aichinger | |
| 4,527,704 | A | 7/1985 | Swartzbaugh | |
| 4,527,706 | A | 7/1985 | Swartzbaugh | |
| 4,550,843 | A | 11/1985 | Nolan | |
| 4,550,844 | A | 11/1985 | Lininger | |
| 4,564,114 | A | 1/1986 | Cole | |
| 4,567,991 | A | 2/1986 | Anderson | |

(Continued)

FOREIGN PATENT DOCUMENTS

| | | |
|---|---|---|
| AU | 633811 B | 6/1989 |
| CN | 108883860 A | 11/2018 |

(Continued)

*Primary Examiner* — Anthony D Stashick
*Assistant Examiner* — Raven Collins
(74) *Attorney, Agent, or Firm* — Fishman Stewart PLLC

(57) ABSTRACT

A container assembly includes a plastic container and a tethered closure. In embodiments, a tethered closure includes a cap, a tamper evident band, a plurality of breakaway connectors, and a connecting portion. The plurality of breakaway connectors connect the tamper evident band to the cap. In embodiments, the connecting portion connects the tamper evident band to the cap, and maintains the connection of the cap to the tamper evident band after the separation of the breakaway connectors from the cap.

32 Claims, 13 Drawing Sheets

(56) References Cited

U.S. PATENT DOCUMENTS

| | | | | |
|---|---|---|---|---|
| 4,592,475 | A | 6/1986 | Hannon | |
| 4,592,476 | A | 6/1986 | Yasada | |
| 4,625,875 | A | 12/1986 | Carr et al. | |
| 4,635,808 | A | 1/1987 | Nolan | |
| 4,653,657 | A | 3/1987 | Papavasilopoulos | |
| 4,657,153 | A | 4/1987 | Hayes | |
| 4,708,255 | A | 11/1987 | Thompson | |
| 4,709,824 | A | 12/1987 | Thompson | |
| 4,784,280 | A | 11/1988 | Breuer | |
| 4,796,770 | A | 1/1989 | Begley | |
| 4,805,792 | A | 2/1989 | Lecinski, Jr. | |
| 4,811,855 | A | 3/1989 | Magnus | |
| 4,811,857 | A | 3/1989 | Thompson | |
| 4,823,967 | A | 4/1989 | Thompson | |
| 4,856,665 | A | 8/1989 | Dutt | |
| 4,856,667 | A | 8/1989 | Thompson | |
| 4,872,304 | A | 10/1989 | Thompson | |
| 4,886,947 | A | 12/1989 | Thompson | |
| 4,925,617 | A | 5/1990 | Thompson | |
| 4,934,556 | A | 6/1990 | Kleissendorf | |
| 4,938,370 | A | 7/1990 | McBride | |
| 4,940,154 | A | 7/1990 | Vollmar | |
| 4,971,212 | A | 11/1990 | Kusz | |
| 5,029,718 | A | 7/1991 | Rizzardi | |
| 5,056,675 | A | 10/1991 | Julian | |
| 5,080,246 | A | 1/1992 | Hayes | |
| 5,086,938 | A | 2/1992 | Aichinger | |
| 5,100,009 | A | 3/1992 | Thompson | |
| 5,145,078 | A | 9/1992 | Hannon | |
| 5,215,204 | A | 6/1993 | Beck et al. | |
| 5,219,507 | A | 6/1993 | Ingram | |
| 5,246,125 | A | 9/1993 | Julian | |
| 5,253,772 | A | 10/1993 | Earnest | |
| 5,320,234 | A | 6/1994 | Kamath | |
| 5,443,171 | A | 8/1995 | Sprowl | |
| 5,462,184 | A | 10/1995 | Ingram | |
| 5,490,827 | A | 2/1996 | Van De Geijn | |
| 5,564,582 | A | 10/1996 | Kamath | |
| 5,605,240 | A | 2/1997 | Guglielmini | |
| 5,611,446 | A | 3/1997 | Ingram | |
| 5,653,382 | A | 8/1997 | Van De Geijn | |
| 5,658,228 | A | 8/1997 | Van De Geijn | |
| 5,673,808 | A | 10/1997 | Valyi | |
| 5,678,714 | A | 10/1997 | Guglielmini | |
| 5,690,882 | A | 11/1997 | Sprowl | |
| 5,725,115 | A | 3/1998 | Bosl et al. | |
| 5,755,347 | A | 5/1998 | Ingram | |
| 5,853,095 | A | 12/1998 | Marshall | |
| 5,875,908 | A | 3/1999 | Witt | |
| 5,891,380 | A | 4/1999 | Larue | |
| 6,062,408 | A | 5/2000 | Beck | |
| 6,085,921 | A | 7/2000 | Brown | |
| 6,089,390 | A | 7/2000 | Druitt | |
| 6,119,883 | A | 9/2000 | Hock | |
| 6,126,886 | A | 10/2000 | Beck | |
| 6,152,316 | A | 11/2000 | Niese | |
| 6,170,683 | B1 | 1/2001 | Montgomery | |
| 6,237,791 | B1 | 5/2001 | Beck | |
| 6,253,939 | B1 | 7/2001 | Wan | |
| 6,264,052 | B1 | 7/2001 | Schmitz | |
| 6,302,286 | B1 | 10/2001 | Witherspoon | |
| 6,306,080 | B1 | 10/2001 | Mitchell | |
| 6,325,225 | B1 | 12/2001 | Druitt | |
| 6,341,707 | B1 | 1/2002 | Witt | |
| 6,382,443 | B1 | 5/2002 | Gregory | |
| 6,460,712 | B2 | 10/2002 | Smith | |
| 6,474,491 | B1 * | 11/2002 | Benoit-Gonin | B65D 41/3428 220/263 |
| 6,527,132 | B1 | 3/2003 | Druitt | |
| 6,622,460 | B2 | 9/2003 | Gregory | |
| 6,705,479 | B2 | 3/2004 | Druitt | |
| 6,968,966 | B2 | 11/2005 | Gregory | |
| 6,991,123 | B2 | 1/2006 | Druitt | |
| 7,059,485 | B1 | 6/2006 | Reidenbach | |
| 7,228,979 | B2 | 6/2007 | Long, Jr. | |
| 7,591,398 | B2 | 9/2009 | Pritikin | |
| 7,703,617 | B1 | 4/2010 | Branson | |
| 7,789,254 | B2 | 9/2010 | Geho | |
| 8,424,697 | B2 | 4/2013 | Pucci | |
| 8,443,993 | B1 | 5/2013 | Desselle | |
| 8,695,822 | B2 | 4/2014 | Kwon | |
| 8,720,716 | B2 | 5/2014 | Campbell | |
| 8,763,830 | B2 | 7/2014 | Sadiq | |
| 9,643,762 | B2 | 5/2017 | Maguire | |
| 9,650,184 | B2 | 5/2017 | Fily | |
| 9,976,835 | B2 | 5/2018 | Pedersen | |
| 10,836,544 | B2 | 11/2020 | Kim | |
| 10,926,923 | B2 * | 2/2021 | Berroa Garcia | B65D 41/32 |
| 10,934,063 | B2 | 3/2021 | Benoit-Gonin | |
| 10,947,015 | B2 | 3/2021 | Smith | |
| 2002/0014467 | A1 | 2/2002 | Reidenbach | |
| 2003/0116523 | A1 | 6/2003 | Druitt | |
| 2003/0192854 | A1 | 10/2003 | Gregory | |
| 2004/0040928 | A1 | 3/2004 | Noonan | |
| 2004/0232100 | A1 | 11/2004 | Reidenbach | |
| 2005/0133508 | A1 | 6/2005 | Landis | |
| 2005/0199573 | A1 | 9/2005 | Last | |
| 2006/0091100 | A1 | 5/2006 | Geho | |
| 2007/0272647 | A1 | 11/2007 | Long | |
| 2008/0073348 | A1 | 3/2008 | Pritikin | |
| 2008/0197135 | A1 | 8/2008 | Berman | |
| 2009/0071927 | A1 | 3/2009 | Fily | |
| 2009/0236304 | A1 * | 9/2009 | Watson | G09F 3/04 215/386 |
| 2009/0314776 | A1 | 12/2009 | Pucci | |
| 2010/0326948 | A1 | 12/2010 | Campbell | |
| 2011/0174760 | A1 | 7/2011 | Luzzato et al. | |
| 2012/0024815 | A1 | 2/2012 | Kwon | |
| 2012/0091134 | A1 | 4/2012 | Sadiq | |
| 2012/0211506 | A1 * | 8/2012 | Cerveny | B65D 47/0804 206/524.6 |
| 2013/0043260 | A1 | 2/2013 | Barron | |
| 2013/0136382 | A1 | 5/2013 | Barron | |
| 2015/0251827 | A1 | 9/2015 | Campbell | |
| 2016/0076863 | A1 | 3/2016 | Pedersen | |
| 2017/0217646 | A1 | 8/2017 | Hanan | |
| 2018/0170625 | A1 | 6/2018 | Sung | |
| 2019/0344933 | A1 | 11/2019 | Kim | |
| 2019/0344944 | A1 | 11/2019 | Maguire | |
| 2019/0375555 | A1 | 12/2019 | Edie et al. | |
| 2020/0017260 | A1 * | 1/2020 | Migas | B65D 55/16 |
| 2020/0115115 | A1 * | 4/2020 | Migas | B65D 1/0246 |
| 2021/0039838 | A1 | 2/2021 | Hanan | |
| 2021/0094733 | A1 | 4/2021 | Bloom et al. | |
| 2021/0179324 | A1 * | 6/2021 | Hanan | B65D 41/0492 |
| 2021/0300634 | A1 * | 9/2021 | Maguire | B65D 41/3428 |
| 2022/0002021 | A1 * | 1/2022 | Krautkramer | B65D 41/3428 |

FOREIGN PATENT DOCUMENTS

| | | | | |
|---|---|---|---|---|
| CN | 111924311 | A * | 11/2020 | B65D 55/16 |
| EP | 1529736 | A2 | 5/2005 | |
| EP | 1591372 | A3 | 4/2006 | |
| JP | 61011359 | A | 1/1986 | |
| JP | 4955988 | B2 | 6/2012 | |
| JP | 2006341924 | A | 6/2012 | |
| JP | 2014043246 | A | 2/2017 | |
| WO | 1987007579 | A1 | 12/1987 | |
| WO | 1991017090 | A1 | 11/1991 | |
| WO | 2000026108 | A1 | 5/2000 | |
| WO | 2006045196 | A1 | 5/2006 | |
| WO | 09/048273 | A2 | 4/2009 | |
| WO | 2016160591 | A1 | 10/2016 | |
| WO | 19/177616 | A1 | 9/2019 | |
| WO | 20/37010 | A1 | 2/2020 | |
| WO | 20/157695 | A1 | 8/2020 | |
| WO | 20/227813 | A1 | 11/2020 | |
| WO | WO-2021014287 | A1 * | 1/2021 | B65D 41/3428 |
| WO | 21/074726 | A1 | 4/2021 | |
| WO | 21/074727 | A1 | 4/2021 | |
| WO | 21/074728 | A1 | 4/2021 | |
| WO | 21/080550 | A1 | 4/2021 | |

* cited by examiner

TETHERED CLOSURE AND CONTAINER ASSEMBLY

CROSS-REFERENCE TO RELATED APPLICATION

This application claims the benefit of priority to U.S. Provisional Application Ser. No. 62/947,137, filed Dec. 12, 2019, which is fully incorporated herein by reference.

TECHNICAL FIELD

The present invention relates to tethered closures and container assemblies with tethered closures.

BACKGROUND

Containers for holding and dispensing contents are known in the art. Conventional container closures may be of the tamper evident type, which can include a tamper evident ring or tamper evident band. Such a band may be intermittently attached to a cap, such as by a plurality of frangible connectors or bridges, and such frangible connectors or bridges may tear away when the cap is unscrewed, so as to provide tamper evidence. Tamper evidence may be indicated, for example, by a tamper evident band remaining attached to a container, and when the cap is reapplied the tamper evident band may indicate a tampering or opening (compromise) of the closure system. Some conventional closures with tamper evident features may remain attached to a bottle or container after opening and may include a hinge or other forms of tether. Such conventional closures commonly require closures with large (height) tamper evident bands, as well as a longer skirt area with a corresponding area on a neck finish of a preform or container to accommodate a hinge, one or more bands, one or more straps or other formations used create a tether apparatus. The corresponding neck finishes typically have significant (greater vertical) distance/space between a tamper evident formation and a support flange, and may include a larger space between the bottom of associated thread(s) and an upper surface of the tamper evident formation. Among other things, having a taller tamper evident band on a closure and corresponding area on a preform or container finish can require additional material, add weight to the closure system including the neck finish, and/or create manufacturing processing and handling inefficiencies. Additionally, some conventional closures include protruding formations, which can add material, weight, and complicated geometries as part of, or in conjunction with, a tether apparatus—such as to fix the closure in place during user consumption—which may enable a consumer to improve control of the connected closure and reduce interference of the closure during consumption. However, such additional formations which may protrude can create closure manufacturing inefficiencies, such as in the injection and compression molding process (e.g. cycle time, quality, etc.) and may require additional tooling. Additionally, such protruding formations can impact or complicate container filling operations.

The foregoing and other challenges can exist with respect to use of hinged or tethered closures, including the use of such tethered closures in connection with shorter or lightweight threaded neck finishes. Shorter or lightweight threaded neck finishes may optimize consumer functionality with reduced material usage, improved operational efficiencies and/or improved sustainability. However such threaded neck finishes may not accommodate conventional tethered closures. While non-threaded snap-cap solutions for short neck finishes may be available, snap-caps are generally substantially heavier, requiring additional material and cost, and they are typically not capable of handling nitrogen dosing or carbonation that may be associated with many beverage products and may further create consumer dissatisfaction with the process of opening and product spillage, particularly in connection with lightweight containers.

Among other things, it can be desirable to provide a tethered closure and container assembly that addresses some or all of the aforementioned challenges, including a tethered closure and container assembly that can accommodate shorter or lightweight threaded neck finishes, and may be used with container assemblies with little or minimal tooling adaptations.

SUMMARY

A container assembly includes a plastic container with a threaded neck finish and tamper evident formation (e.g., a tamper evident bead or pilfer bead) and a tethered closure. In embodiments, a tethered closure includes a cap, a tamper evident band, a plurality of breakaway connectors (or bridges), and a connecting portion or area. The plurality of breakaway connectors connect the tamper evident band to the cap. In embodiments, the connecting portion connects the tamper evident band to the cap, and maintains the connection of the cap to the tamper evident band and the open container after the separation of the breakaway connectors from the cap.

BRIEF DESCRIPTION OF THE DRAWINGS

Embodiments of the disclosure will now be described, by way of example, with reference to the accompanying drawings, wherein.

DETAILED DESCRIPTION

Reference will now be made in detail to embodiments of the present disclosure, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined herein and by appended claims.

Figure 1:
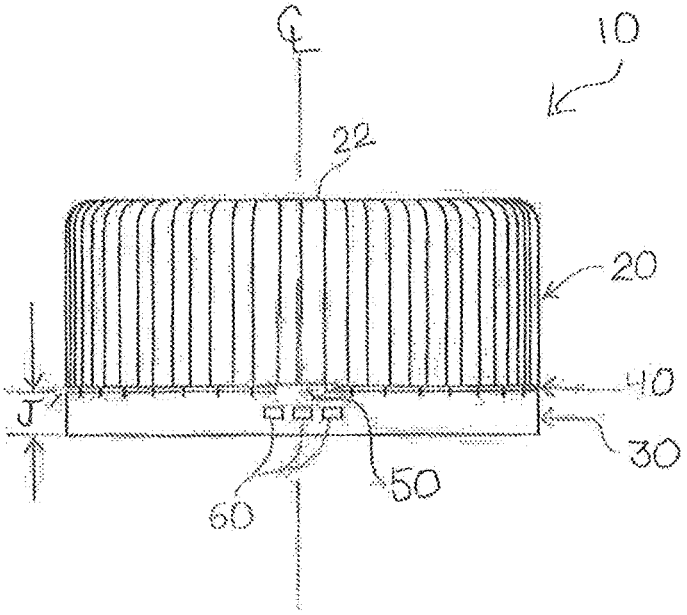
FIG. 1 is a side elevation view of an embodiment of a closure according to aspects or teachings of the present disclosure.
Figure 6:
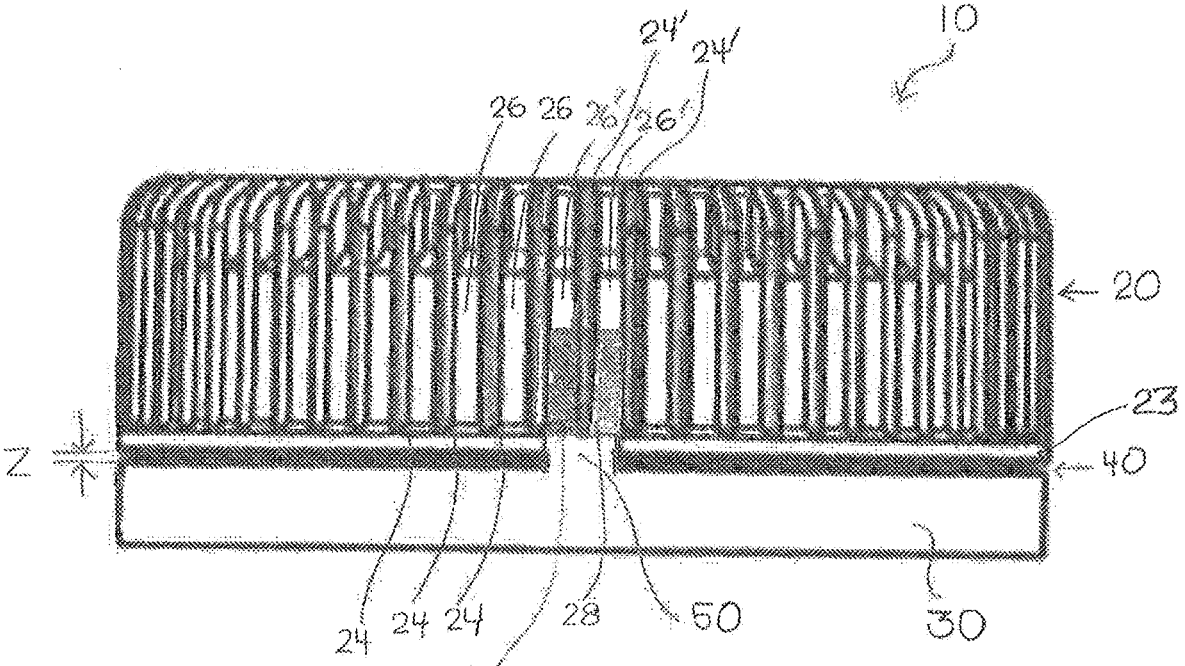
FIG. 6 is side elevation view of an embodiment of a closure according to aspects or teachings of the present disclosure.

With reference to FIG. 1, an embodiment of a tethered closure 10 in accordance with aspects and teachings of the present disclosure is generally illustrated. The closure 10 may be comprised of plastic. For example and without limitation, the closure 10 may be comprised of high density polyethylene (HDPE), polypropylene (PP), polyethylene terephthalate (PET), and/or other thermoplastic materials. The closure may be formed as a single-piece, unitary component, or may be formed as a two-piece structure that includes an inner liner, such as for sealing the top surface of a neck finish opening. As generally illustrated in FIGS. 1 and 6, an embodiment of a closure 10 may include a cap 20 with a closed top surface 22, a skirt 23, and a tamper evident band (or tamper evident ring) 30.

The cap 20 (which may comprise a closed top surface 22 and a skirt 23) may include internal (e.g., female) threads that may be configured to engage one or more external (e.g., male) threads provided on a container neck finish portion. The tamper evident band 30 may be connected to the cap 20 via a plurality of breakaway connectors (or bridges) 40, which may be intermittent and may extend around a significant portion of the circumference of the closure 10 about the tamper evident band 30. Such breakaway connectors 40 may be configured to separate or tear away (such as break or tear away from the cap 20) as the closure 10 is unscrewed. The closure 10 may further include a connecting portion 50, which may be an integrated connecting portion. A connecting portion 50 may be configured to remain tethered or connected to the cap 20 when the cap is otherwise separated from the tamper evident band 30, such as when the breakaway connectors 40 are broken, severed and/or separated. In embodiments, a connecting portion 50 may comprise a structure that is not continuous circumferentially (e.g., may have several structural portions/components to provide tethering) or includes structural interruptions within a 90° range along a circumference of a cap and/or may have varying thickness to provide for flexibility with respect to opening.

As generally shown in FIG. 1, the outer radial extents of the lower portion of the cap 20 and the outer radial extent of the tamper evident band 30 may be substantially aligned, such that there is little or no radial extension or flare out of the breakaway connectors 40 or tamper evident band 30. However, the disclosure is not limited to the closure depicted, and may be utilized in connection with closures (e.g., closures associated with pressurized or carbonated contents) that include a flare out of the lower portion of the closure, for example, to accommodate a slightly larger diameter in that region. In embodiments, the breakaway connectors 40 may be disposed within a small distance or vertical dimension Z (see, e.g., FIG. 6) or slit provided between the cap 20 and the tamper evident band 30. The dimension Z may be very small, and in embodiments may be barely or not visible or perceptible to the eye of a consumer. For example and without limitation, dimension Z may be about 0.5 mm or less, may be about 0.3 mm or less, may be about 0.15 mm, may be about 0.075 mm, or may be about 0.050 mm. Further, as generally shown, the tamper evident band 30 may have a vertical height or dimension, generally designated as dimension J'. In embodiments, the dimension J' may be about 4 mm, may be about 3.5 mm, or may be about 3 mm or less. For some embodiments, the range of dimension J' may range from at or about 1.5 mm to at or about 3.25 mm. For example and without limitation, dimension J' may be at or about 3 mm in connection with a 26 mm-type outer diameter (OD) closure. In other embodiments, for example and without limitation, the dimension J' may be at or about 3.5 mm, 3.25 mm, 3.00 mm, 2.25 mm, 2.00 mm, 1.75 mm, and may even be at or about 1.5 mm. With embodiments, the dimension J' will generally be sufficiently sized or configured at no less than 1 mm so as to provide sufficient structure to function, including with any inward protrusions, mass, and strength, such that the tamper evident band 30 will not easily rip off or separate from a container.

Figure 2:
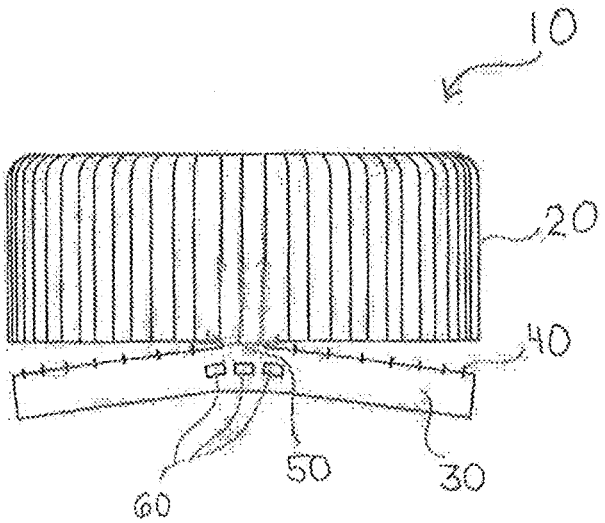
FIG. 2 is a side elevation view of an embodiment of a closure of the type illustrated in FIG. 1, shown with separation between a cap and a tamper evident band.
Figure 2A:
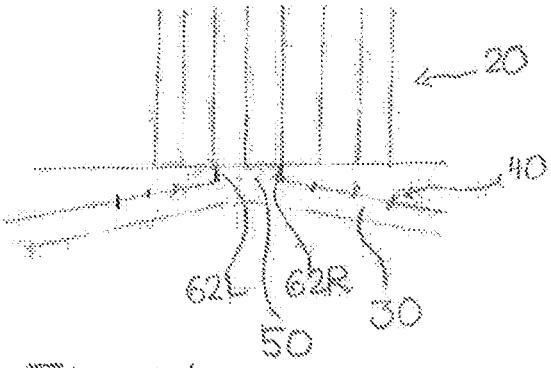
FIG. 2A is an enlarged view of a portion of a closure as generally illustrated in FIG. 2.
Figure 3:
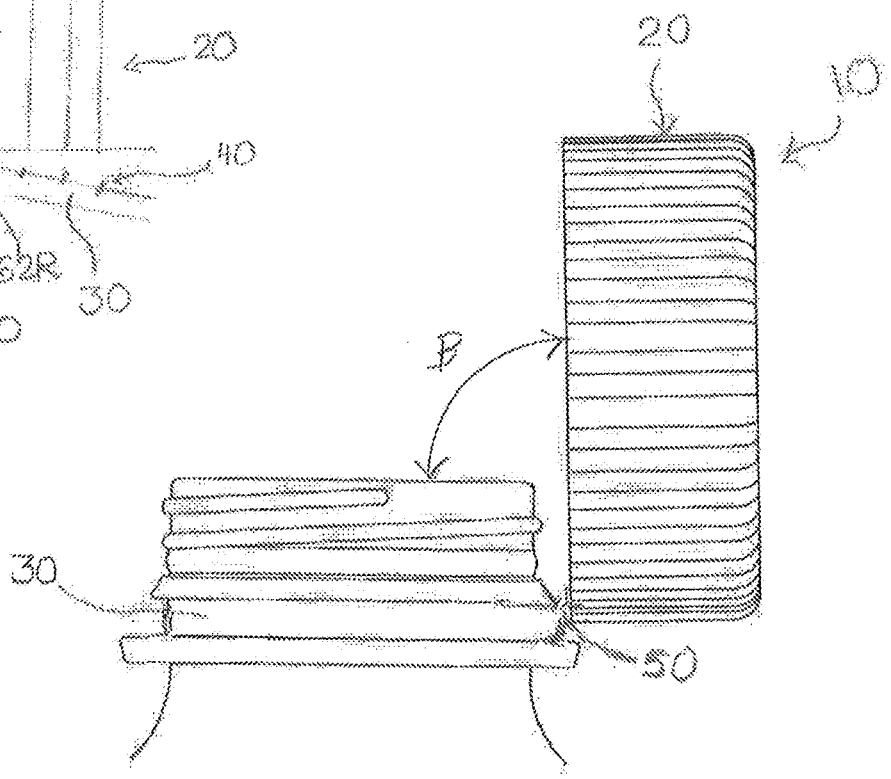
FIG. 3 is partial elevation view generally illustrating an embodiment of a closure attached to a neck finish portion of a container.

FIG. 2 generally illustrates an embodiment of a closure similar to that shown in FIG. 1 in which the breakaway connectors 40 are shown separated from the cap 20. As generally illustrated, the cap 20 remains connected to the tamper evident band 30 via the connecting portion 50. FIG. 3 generally illustrates an embodiment of a closure similar to that shown in FIG. 2 in which a closure 10 is included on a neck portion of a container, and the cap 20 is generally illustrated in an open configuration. In the illustrated configuration, access is permitted to the contents of the container while the cap 20 remains attached to the tamper evident band 30, and hence the neck portion of the container, via the connecting portion 50.

Figure 4:
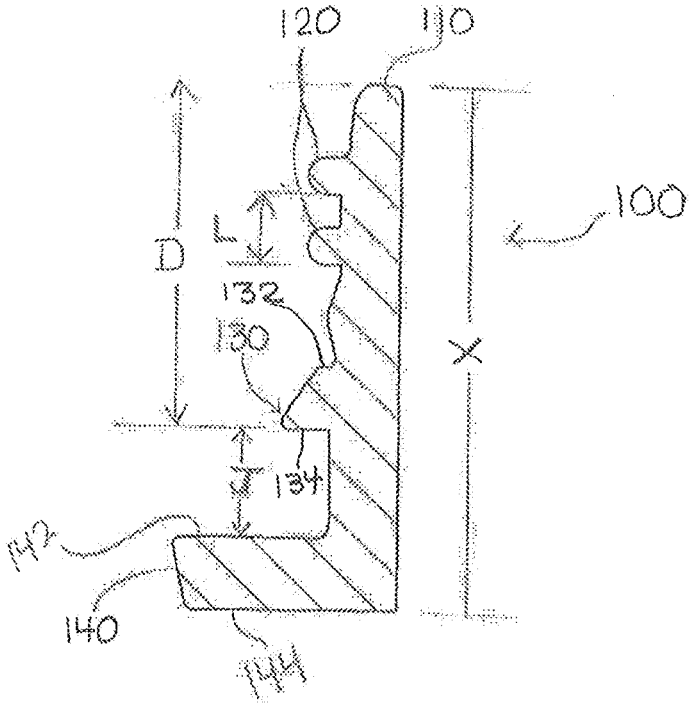
FIG. 4 is a partial sectional view of a neck finish portion of an embodiment of a preform or container.
Figure 5:
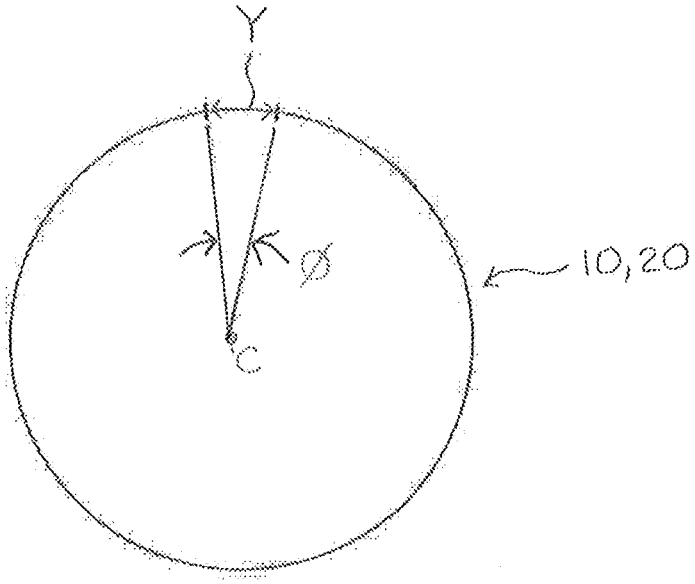
FIG. 5 is top plan illustration of a closure or a cap.

A representation of an embodiment of a neck finish portion 100 is generally illustrated in FIG. 4. The neck finish portion 100 may be part of a plastic container, which may be molded using various methods to form a resulting plastic container. As generally illustrated in FIG. 4, the neck finish portion 100 may include an upper point or surface 110 (i.e., at the top of the finish), threads 120, a tamper evident formation 130 having an upper surface 132 and a lower surface 134, and a support flange 140 having an upper surface 142 and lower surface 144. In the illustrated embodiment of the neck portion 100, including those in FIGS. 4 and 17A, the following dimensions are identified:

X—the height or vertical distance from an upper point or surface 110 (i.e., at the top of the finish) to the lower surface 144 of the support flange 140;

D—the height or vertical distance from an upper point or surface 110 to a lower surface of the tamper evident formation 130;

J—the height or vertical distance from an upper surface 142 of the support flange 140 and a lower surface 134 of the tamper evident formation 130; and L—the height or vertical distance from a lower portion of an upper thread portion to a lower portion of a lower thread portion. In general, and as referenced in the art, an associated "thread pitch" or "lift" may be the distance of thread engagement between the cap and a neck finish portion.

In embodiments, the tamper evident formation 130 may be configured to retain a tamper evident band 30 in a vertical position under the tamper evident formation 130 and above a support flange 140. Without limitation, the extent of the upper most surface of the tamper evident band 130 may comprise some or all of the outer vertical distance of the tamper evident formation 130 and may exceed the entire vertical distance of the tamper evident formation 130. The tamper evident band 130 will not exceed or extend to the lowest point of the thread(s) 120. With embodiments, the dimension J associated with the neck finish portion 100 will be equal to or greater than the dimension J' associated with the tamper evident band 30. In other embodiments, J' can be greater than J by 0.01 inches (0.254 mm) to 0.1 inches (2.54 mm) as a portion of the tamper evident band wall 32 may move above a lower portion 134 of the tamper evident formation 130.

As generally illustrated in the top representation shown in FIG. 6, the connecting portion 50 may circumferentially extend around the closure/band a circumferential distance (e.g., arc distance), generally designated as dimension Y (which may alternative be referenced in terms of a radial extent, e.g., in an angular form (e.g., angle (Ø) about a center (C)) or a portion or subset of a 360° full extent about a centerline of the closure). In embodiments, if the circumferential distance Y or the associated angle Ø is too great, the connecting portion 50 may not sufficiently permit an associated cap 20 from moving to an intended position to provide desired access to the contents of the container. Additionally, with embodiments, the thickness of the connecting portion 50 may be varied along its circumferential length (e.g., viewed from a top plan perspective). Such thinning out of thickness circumferentially from a central portion of a connecting portion 50 may serve as a web to provide added flexibility. For example and without limitation, the thickness of a connecting portion 50 may be greatest at its circumferential mid-point or mid-length and may be comparatively less thick at portions of the connecting portion that extend from or are remote from such circumferential mid-point or mid-length.

In embodiments, the circumferential distance of the connecting portion (Y) is greater than or equal to the vertical height of the tamper evident band (J'), i.e., Y≥J'. The foregoing comparative ratio may be generally functionally acceptable up to a point at which dimension Y does not permit the connecting portion 50 to adequately function (e.g., flex or bend) so as to position or re-position the cap 20. For example and without limitation, the associated angle θ of the connecting portion 50 about a vertical centerline of the closure or cap may be about 90°, about 75°, about 60°, about 45°, about 30°, about 15°, about 7.5°, about 5°, and about 2.5°, and, for some applications, angle θ may preferably be in the range of (i) about 5° to about 45° or (ii) about 10° to about 15°. However, for a number of embodiments, the associated angle θ of the connecting portion 50 will be 30° or less. In general, the lower the angle θ, the easier it may be for a user to open the closure; however, the greater the Y dimension the more connection strength that is provided. The opening angle β, upon initially opening a cap 20 about 90 degrees (see, e.g., FIG. 3) from the neck finish portion, and then stretching and flexing the connecting portion 50 and to position the cap 20 at an opening angle β greater than 90 degrees. With embodiments, for example and without limitation, a cap 20 may be positioned at an opening angle β between about 150 to about 235 degrees and may be configured to provide user consumption without closure/cap interference.

With embodiments, a user may physically assist (through various means) with the holding or retention of an opened cap 20 back in a position that is greater than 90 degrees to help avoid interference of the cap, for example, with direct consumption or pouring. Embodiments of a connecting portion 50 may have a minimum vertical dimension of 1 mm to provide sufficient strength to avoid tear-off and to eliminate the connection (tethering) to the tamper evident band 30. In embodiments, a connecting portion 50 connecting a cap 20 and tamper evident band 30 may have a minimum tear-off resistance in vertical and horizontal direction of 7 N (Newton), and may have a tear-off resistance in vertical and horizontal direction of at least 25 N. The connection portion 50 should withstand at least three openings and closings of a cap on the container, and may withstand up to at least 15 openings and closings of a cap on the container. Tear-off resistance and opening and closing technical testing procedures for the foregoing may, for instance, be as established and prescribed in the European Union Directive 2019/904 CEN Standardization of Technical requirements.

Additionally, with embodiments, the circumferential distance Y is greater than the horizontal (width) dimension of individual breakaway connectors 40. Further, in embodiments, the circumferential distance Y is at least two times the horizontal (width) dimension of an individual breakaway connector 40.

Further, in embodiments, the cap 20 may include a plurality of vertically extending knurls 24 (see, e.g., FIG. 6). The knurls 24 may be disposed (e.g., radially) around all, or one or more segments or portions of the circumference of the cap 20. The knurls 24 may have portions that extend radially outward and/or the knurls 24 may have intervening spaces (or strips) 26 provided in between adjacent knurls 24. Among other things, when included, knurls may provide added structure for the cap 20 and/or help facilitate the rotation of a cap 20 by a user. In embodiments, knurls 24' that are disposed and/or extend above the connecting portion 50 may have a region or regions 28 comprised of intervening spaces 26' that are all or partially "filled in" (e.g., upon formation) or otherwise unformed (without material removed) so that there is a region in the cap 20 above the connecting portion 50 that includes a measure of increased thickness and/or additional material. Such increased thickness and/or material provided in the cap 20 above the connecting portion 50 may extend, for example and without limitation, for the full vertical extent of the knurls, one-half the vertical extent of the knurls, one-quarter the vertical extent of the knurls, or some other partial extent of the knurls that provides improved functional performance. Having an increased thickness and/or additional material in the cap 20 above all or a circumferential portion of the connecting portion 50 may, among other things, facilitate the bending of the connecting portion 50 into various positions, improve structural integrity, and/or improve the strength of the connecting portion.

Further, with some embodiments, a portion of the tamper evident band 30 that is below the connecting portion 50 may optionally include small portions (e.g., one or more blocks 60—see, e.g., FIGS. 1 and 2) with material either added or removed (which can adjust the performance of the connecting portion 50 with respect to movement of the cap 20). Such blocks 60 may be provided in a single row across, or may, for example and without limitation, be provided in other patterns, such as more than one row with staggered blocks. Such blocks 60 may be fairly small, for example, with a width between about 0.50 mm to about 8.00 mm and a height between about 0.20 mm and 1.5 mm, comparatively, as the amount of room associated with the J' dimension of the tamper evident band 30 is commonly 3 mm or less, and the tamper evident band 30 should maintain sufficient operational function/integrity. In embodiments, the height of the block 60 may be 50% or less than J' and/or the width of a block may be less than 20% of the circumference or less than 72 degrees (Y). In embodiments, the elimination of some the material in the tamper evident band 30 beneath the connecting portion 50 can provide some additional bending functionality with respect to the tilting of the cap 20 following separation of the breakaway connectors 40.

Figure 7:
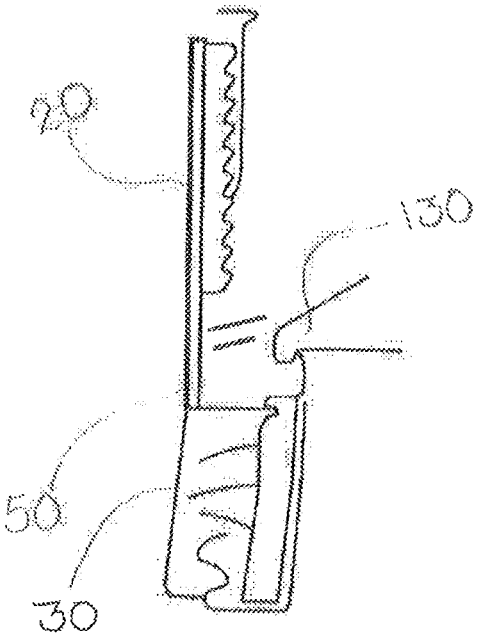
FIG. 7 is a partial sectional view representation of a portion of a closure connected to a portion of a neck portion of a container according to aspects or teachings of the present disclosure.
Figure 8:
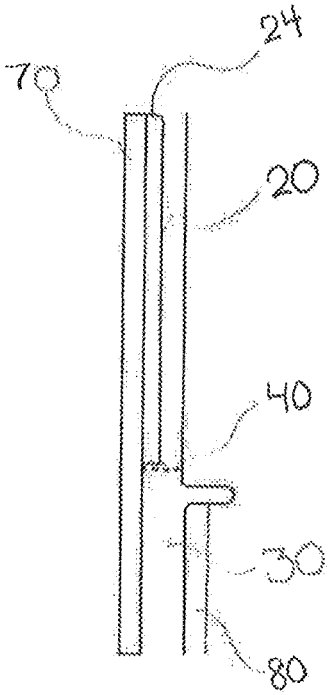
FIG. 8 is a partial sectional view representation of a portion of a closure according to aspects or teachings of the present disclosure.

Additionally, FIG. 7 generally illustrates an embodiment of a connection between a closure and a neck portion. FIG. 8 generally illustrates another embodiment of closure in which the closure includes the addition of a little bit of additional material (e.g., additional layer 70) that is disposed on the outside of the closure and/or an additional material (e.g. additional layer 80) that is disposed on an interior portion of the tamper evident band. Such additional materials may provide additional functionality to the closure. By way of example, and without limitation, the thickness of the additional layer 70 and/or additional layer 80 may be about 0.003 inches. With embodiments, the maximum additional layer 70 and/or additional layer 80 is about 0.500 inches while not exceeding other protruding radial dimensions, such as those associated with a ledge 34 (see, e.g., FIG. 12) or outer most dimension of a closure 10 such as a skirt 23 or a tamper evident band 30 (J'W).

Figure 9:
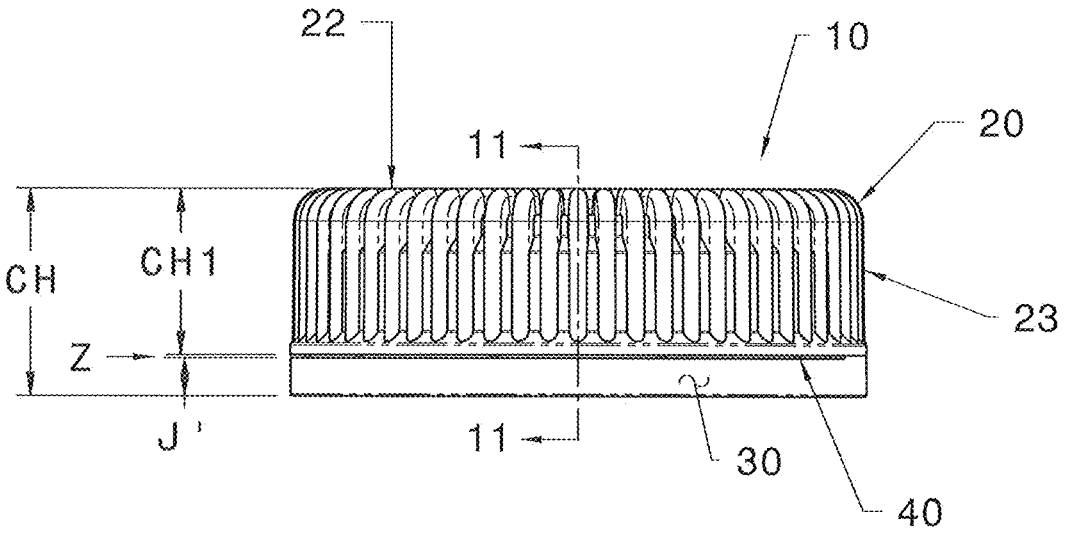
FIG. 9 is side elevation view of another embodiment of a closure according to aspects or teachings of the present disclosure.
Figure 10:
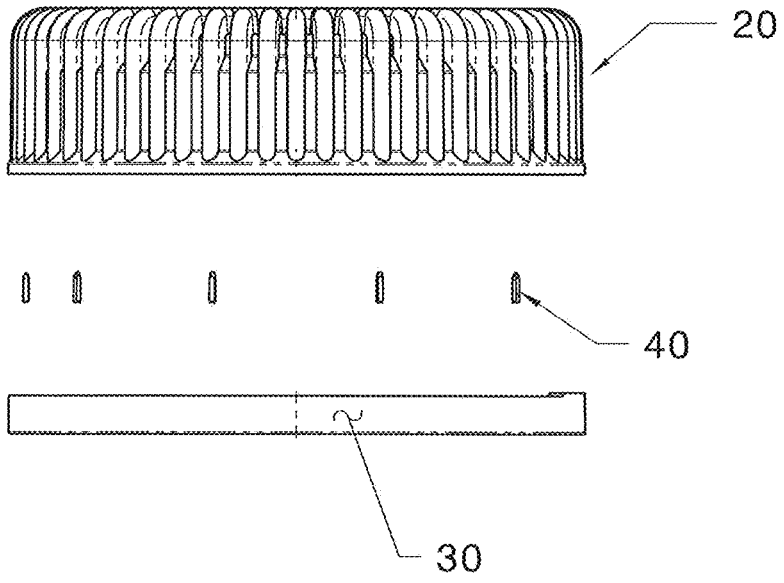
FIG. 10 is an exploded side elevation view of an embodiment of a closure as generally shown in FIG. 9.

Another embodiment of a tethered closure 10 in accordance with aspects and teachings of the present disclosure is illustrated in FIG. 9. As generally illustrated in FIG. 9, an embodiment of a closure 10 may include a cap 20 with a closed top surface 22 and a skirt 23, breakaway connectors 40, and a tamper evident band (or tamper evident ring) 30. By way of example and without limitation, the closure 10 may have a closure height CH dimension of about 0.374 in. (9.50 mm), a cap height CH1 dimension of about 0.299 in. (7.60 mm), a Z dimension of about 0.006 in. (0.15 mm), and a J' dimension (associated with the tamper evident band) of about 0.069 in. (1.75 mm). With embodiments of the disclosure, such as shown, the ratio of Z to J' may be about 0.10 or less, may be about 0.090 or less, or may be about 0.086 or less. Further, with embodiments, the ratio of Z and J' to CH may be about 0.25, may be about 0.22, may be about 0.20, or may be less than 0.20. In embodiments, a Z dimension may be as low as 0.002 in (0.051 mm). FIG. 10 is an exploded illustration of the closure 10 depicted in FIG. 9, showing the cap 20, tamper evident band 30, and the breakaway connectors 40 separated from each other.

Figure 11:
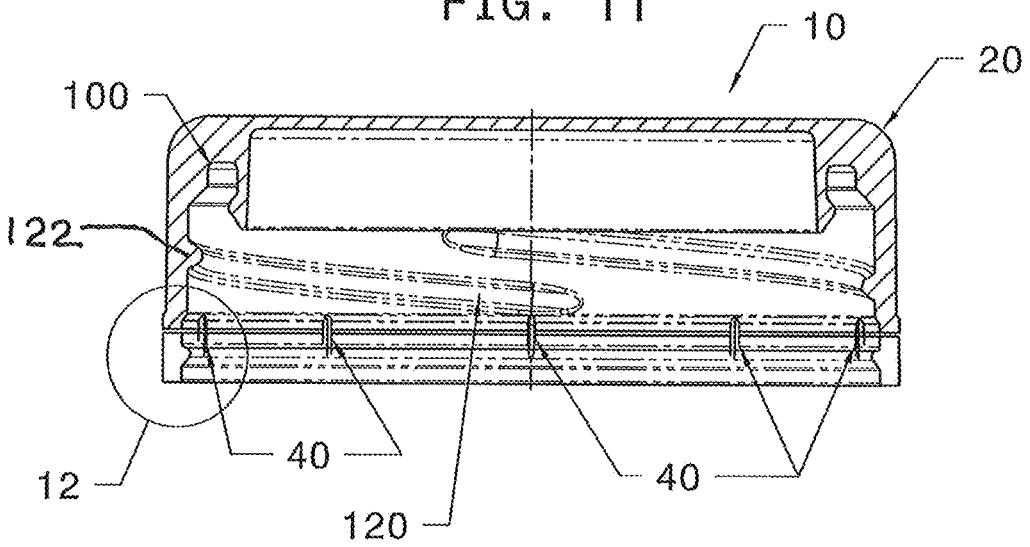
FIG. 11 is sectional view of an embodiment of a closure as generally shown in FIG. 9.

FIG. 11 is sectional view of an embodiment of a closure as generally shown in FIG. 9. The figure generally illustrates a closure assembly 10 with a neck finish portion 100 that includes threads 120, internal cap threads 122, and the associated interaction. The figure illustrates the symmetrical placement and position of bridges 40. The bottom of the cap 20 (i.e., the lower dimension of CH1) may seat or contact the tamper evident formation 130. The internal cap threads 122 when fully engaged with the cap screwed on can interact with the tamper evident formation 30. For some embodiments and applications, the tamper evident formation 130 will be the structure that stops the closure 10 application.

Figure 12:
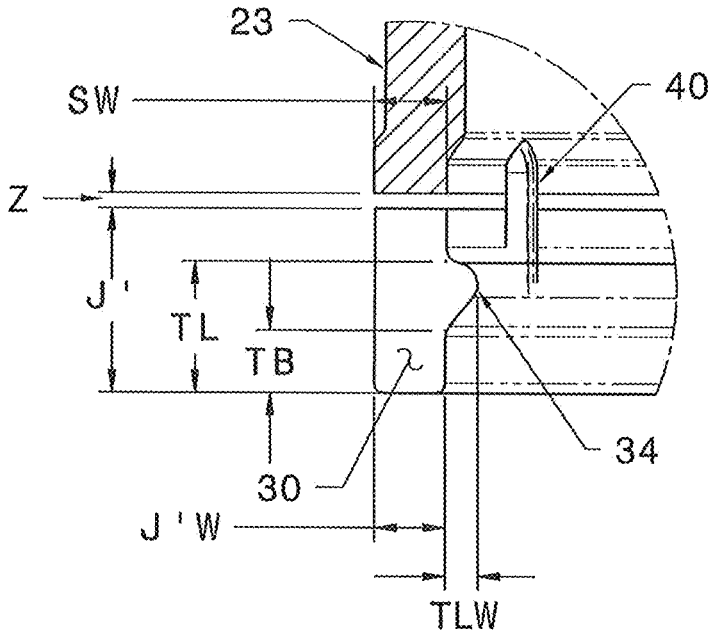
FIG. 12 is an enlarged sectional view of a portion of FIG. 11.

FIG. 12 is an enlarged detail view of a portion of the sectional view of FIG. 11. A portion of a skirt 23 of the cap 20 is shown connected by breakaway connectors 40 to a tamper evident band 30. As generally illustrated, the tamper evident band 30 may include an inward radial-extending portion, which may be referred to as a ledge 34. The illustrated distance TB provides a measure of play for seating the closure 10 on a neck finish portion and engaging associated threads. For example and without limitation, an embodiment such as illustrated may have the following dimensions:

Z—0.006 in. (0.15 mm)
J'—0.069 in. (1.75 mm)
TL—0.049 in (1.25 mm)
TB—0.023 in. (0.60 mm)
J'W—0.027 in. (0.68 mm)
TLW—0.012 in. (0.32 mm)

In embodiments, a connecting portion 50 may not be configured to be wider than the outermost radius point of a cap 20 and a tamper evident band 30 to provide for efficient manufacturing and/or applying a closure to a container. A tamper evident band 30 width J'W may range, for example, from about 0.015 in. (0.381 mm) to about 0.100 in. (2.54 mm). With some embodiments, the dimension J'W may range from about 0.025 in. (0.64 mm) to about 0.065 in. (1.65 mm). In embodiments, the dimension J'W may be reduced to about 0.040 in. (1.02 mm) or less, or even 0.030 in. (0.76 mm) or less, to reduce material while maintaining structural/operational integrity. With some embodiments for non-carbonated, nitrogen dosed and low carbonated products, J'W may be reduced to about 0.020 in. (0.51 mm) or less. Correspondingly, a skirt width SW may range from about 0.015 in. (0.381 mm) to about 0.100 in. (2.54 mm). In embodiments, the dimension SW may range from about 0.025 in. (0.64 mm) to about 0.065 in. (1.65 mm). In embodiments, the dimension SW may be reduced to about 0.040 in. (1.02 mm) or less, or even 0.030 in. (0.76 mm) or less, to reduce material while maintaining structural/operational integrity. With some embodiments for non-carbonated, nitrogen dosed and low carbonated products, SW may be reduced to about 0.020 in. (0.51 mm) or less. In embodiments, a connecting portion 50 has a width equal to or less than J'W and SW. The connecting portion 50 may have a width that is thicker at or about its mid-length or center (e.g., 0.027 in. (0.69 mm)) that is substantially equal to J'W and SW while reducing its thickness from its center to, for example, a remote thickness of about 0.001 in. (0.0254 mm) to create a web-like or film connection on the outer areas of the connecting portion 50 where the connecting portion 50 stretches its furthest distance. The connecting portion 50 is not limited to a specified center thickness, but rather may comprise various combinations of thicker and thinner portions or segments to allow for (or tune) opening and provide tear-off resistance. Additionally, a connecting portion 50 may vary in thickness from an upper portion connecting to a cap 20 to a lower connection to a tamper evident band 30.

In embodiments, a connecting portion 50 may vary in thickness along its entire dimensional width, length, and height.

Figure 13:
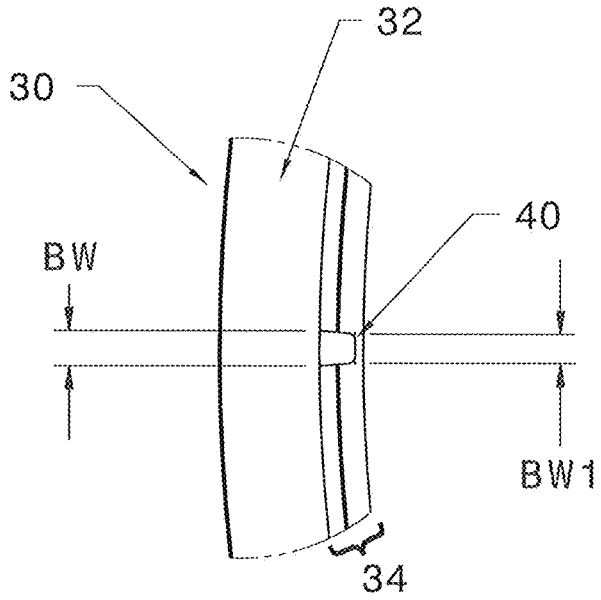
FIG. 13 is an enlarged top sectional view of a lower portion of the closure generally shown in FIG. 9.

FIG. 13 is an enlarged top sectional view of a lower portion of a closure 20—comprising a tamper evident band 30—shown below a cap 20. As generally illustrated, the tamper evident band 30 may comprise, in a top plan view, a wall portion 32 and a ledge 34. The illustrated figure includes a breakaway connector 40. In embodiments, the breakaway connectors may have a radially inward taper (BW being greater than BW1). For example and without limitation, the top plan dimensions BW and BW1 associated with a breakaway connector 40 may be 0.010 in (0.24 mm) and 0.008 in. (0.20 mm), respectively.

Figure 14:
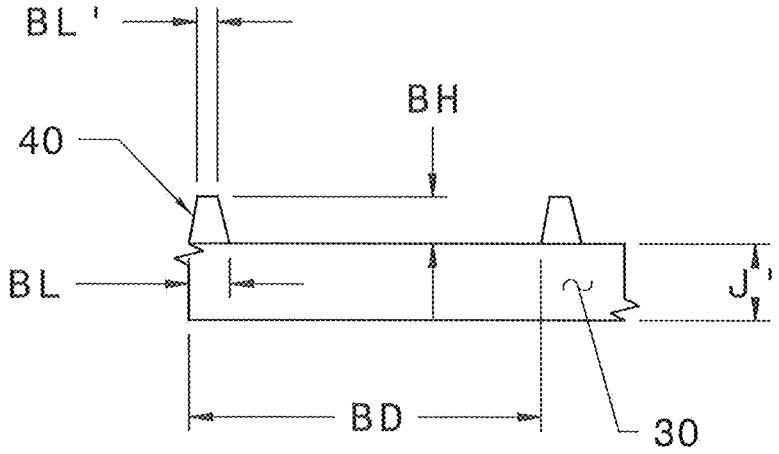
FIG. 14 is side elevation view of a portion of a tamper evident band of an embodiment of a closure.

FIG. 14 is side elevation view of a portion of a tamper evident band 30 of an embodiment of a closure 10. The figure generally illustrates a spacing of breakaway connectors 40 associated with an embodiment of a closure in accordance with aspects or teachings of the disclosure. For example and without limitation, a distance between breakaway connectors (or bridges) BD may be 0.318 in. (8.07 mm). Additionally, for example and without limitation, an embodiment such as illustrated may have the following dimensions:

BL'—0.008 in. (0.20 mm)
BH—0.055 in. (1.39 mm)
BL—0.011 in (0.28 mm)
J'—0.069 in. (1.75 mm)

In embodiments, BL' may range from about 0.002 in (0.05 mm) to about 0.044 in. (1.12 mm), such as where Y equals 5 degrees or less; BH may range from about 0.020 in. (0.51 mm) to about 0.08 in. (2.03 mm); and BL may range from about 0.002 in (0.05 mm) to about 0.044 in. (1.12 mm), such as where Y equals 5 degrees or less, with BL and BL' commonly being between about 0.008 in. (0.20 mm) and about 0.024 in. (0.61 mm).

Figure 15:
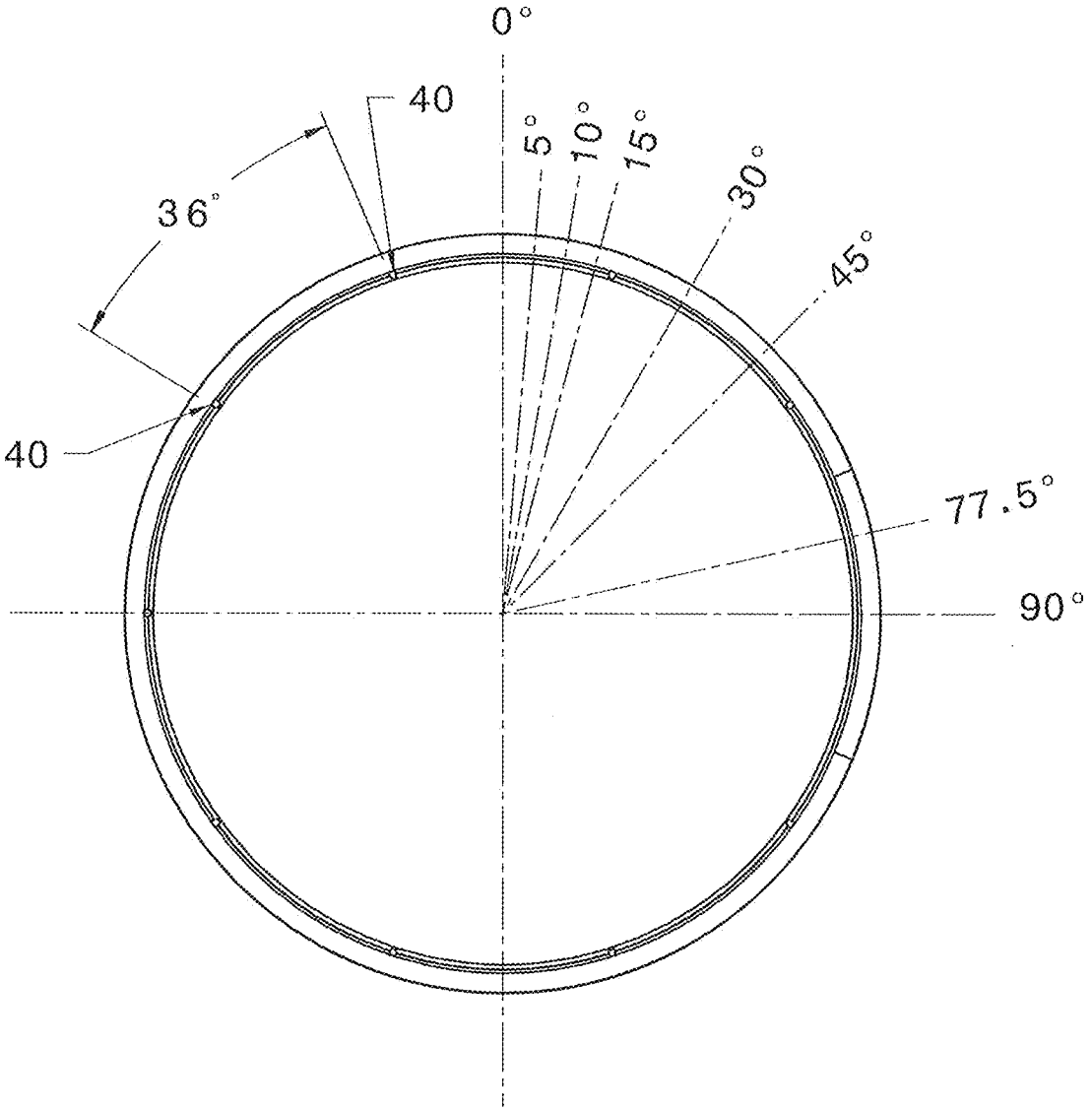
FIG. 15 is top plan illustration of a closure or a cap.

FIG. 15 is top plan illustration of a closure or a cap. As generally illustrated in the embodiment, the breakaway connectors 40 may be circumferentially spaced generally equidistantly around the cap or closure at angular positions—for example, at or about consistent 36° angular increments. However, as also generally illustrated in the figure, the breakaway connectors 40 may, for example, instead be spaced at or about 5°, 10°, 15°, 30°, 45°, 77.5°, or 90° angular increments. The spacing between successive/adjacent breakaway connectors may or may not be consistent (e.g., equidistantly spaced) around the circumference. In embodiments, the connecting portion 50 may, for example and without limitation, be incorporated into or included as part of one or more breakaway connectors or bridges 40. In other embodiments, a connection portion 50 may be provided as a separate element/structure provided in between breakaway connectors or bridges 40.

Figure 16:
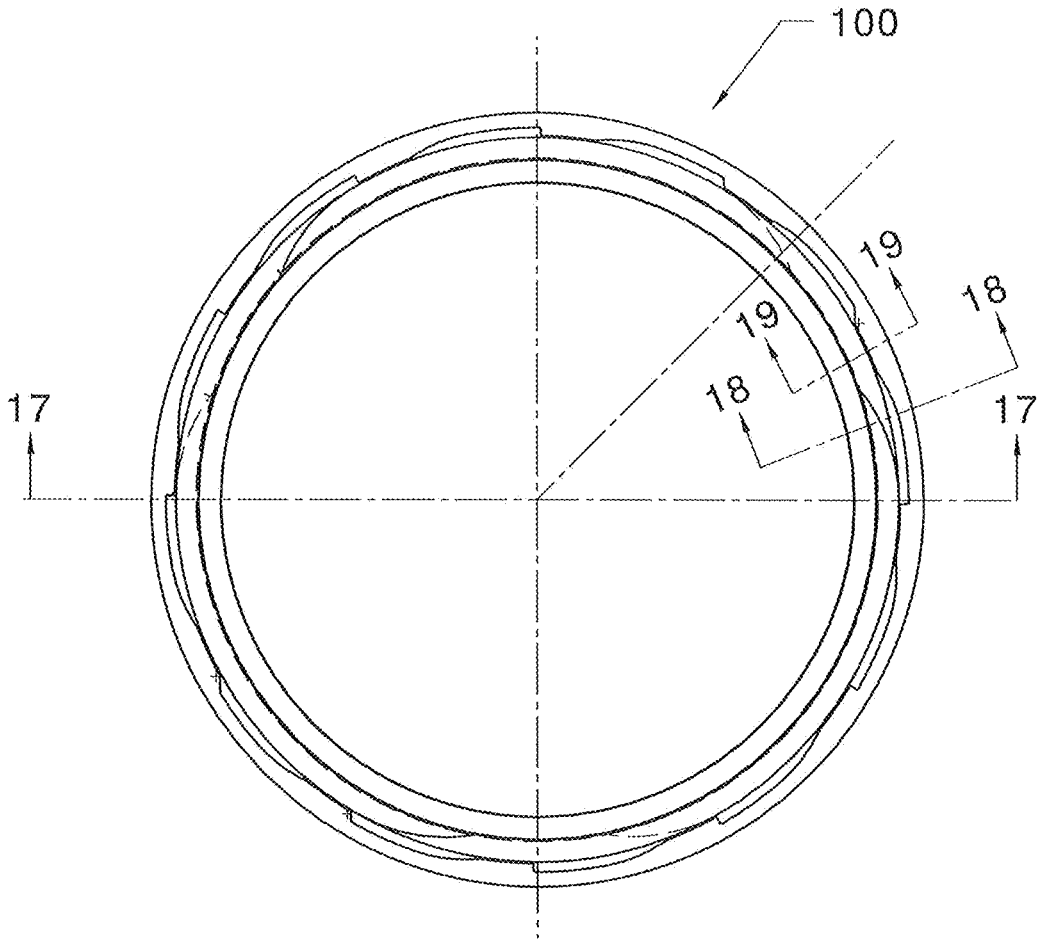
FIG. 16 is a top plan view of a neck finish portion of an embodiment of a preform or container.
Figure 17A:
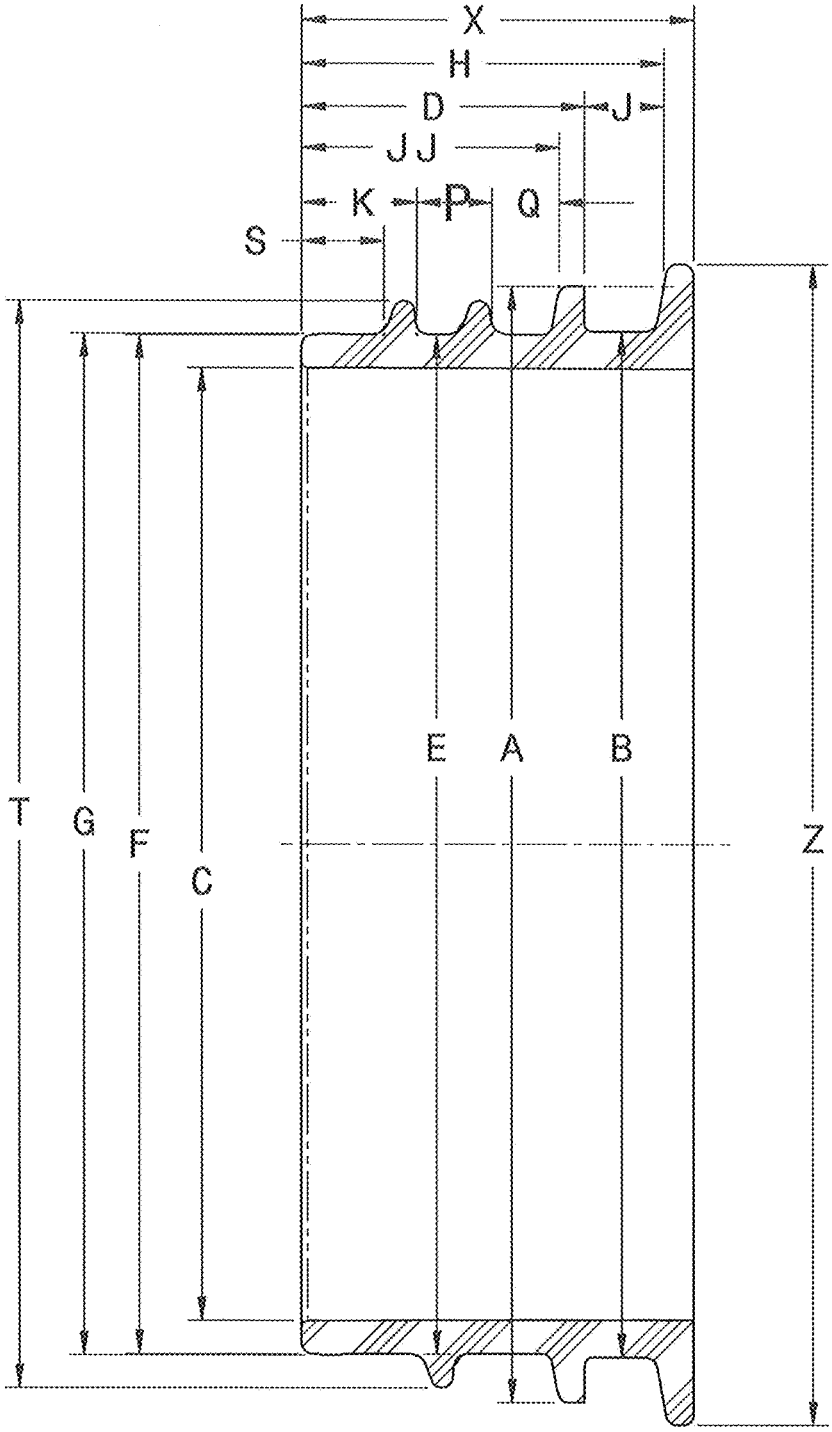
FIG. 17A is a sectional view of a neck finish portion of an embodiment of a preform or container, such as illustrated in FIG. 16.

FIG. 16 is a top plan view of a neck finish portion 100 of an embodiment of a preform or container. FIG. 17A is a sectional view of the neck finish portion 100 generally illustrated in FIG. 16. As generally illustrated, dimension S represents a vertical distance prior to a portion of a thread, and the dimension P represents a pitch between threads. The pitch could be associated with a single lead thread, a double lead thread, or a triple lead thread. Additionally, for example and without limitation, an embodiment such as illustrated may have the following dimensions:

T—0.980 in. (24.90 mm)
G—0.921 in. (23.40 mm)
F—0.919 in (23.35 mm)
C—0.859 in. (21.83 mm)
E—0.919 in. (23.35 mm)
A—1.007 in. (25.58 mm)
B—0.925 in. (23.50 mm)
S—0.057 in. (1.45 mm)
P—0.068 in. (1.73 mm)
Q—0.100 in. (2.54 mm)
JJ—0.231 in. (5.87 mm)
D—0.256 in. (6.50 mm)
H—0.327 in. (8.32 mm)
X—0.354 in (9.00 mm)

In embodiments, dimension S may be 1.5 mm or less, and may range from about 0.5 mm to about 2.0 mm. A shorter dimension S will typically make it easier for cap removal with greater Y (degrees of connection) or strength. An S dimension is needed before a closure vertically reaches neck finish threads to permit seating of a closure on top of a neck finish for engagement and to help reduce capping issues (e.g., cocked caps, over/under torque, leakers, etc). With embodiments, the Q dimension may, for example, be about 0.100 in. (2.54 mm) or less, be about 0.080 in. (2.03 mm) or less, may be about 0.060 in. (1.52 mm) or less, may be about .040 in. (1.02 mm) or less, and may range from about 0.50 in (1.27 mm) to about 0.080 in. (2.03 mm). In embodiments, a Q dimension of at least about minimum 0.010 in. (0.254 mm) will permit an internal thread of a cap 20 to seat or rest on an upper surface of a tamper evident formation and the lowest thread. Typically, a Q dimension will not exceed 0.14 in. (3.56 mm). The disclosed configurations can help minimize radial cap skirt dimensions, thus reducing opening interference while allowing threads to mate within tolerance.

For example and without limitation, in embodiments dimension D may range from about 0.30 in. (7.62 mm) to about 0.15 in. (3.81 mm); dimension H may range from about 0.43 in. (10.92 mm) to about 0.20 in. (5.08 mm); and/or dimension S may be less than about 0.06 in. (1.5 mm). Additionally, various dimensions for elements/features as illustrated or set forth in this disclosure, such as for example, with tamper evident formations and other neck finish elements, may be provided in accordance with their normal gauge points or as otherwise understood and appreciated in the industry and by persons of skill in the field.

Figure 17B:
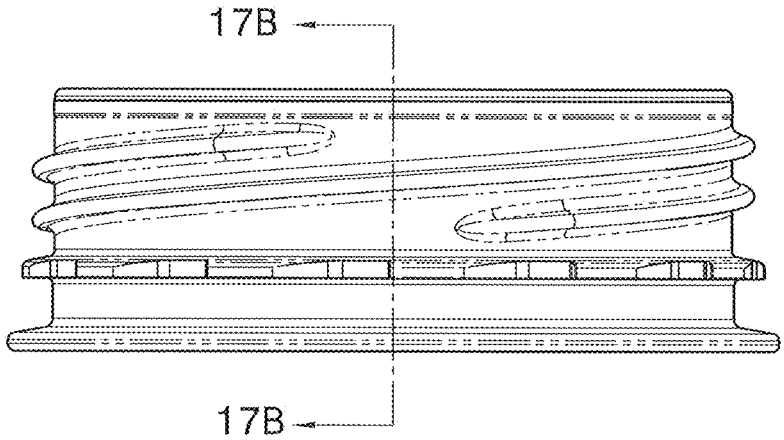
FIG. 17B is a front view of a neck finish portion of an embodiment of a preform or container.
Figure 17C:
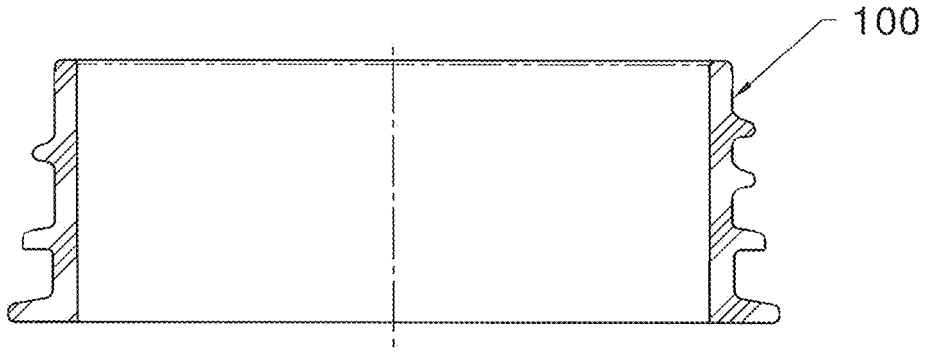
FIG. 17C is a sectional view of a neck finish portion of the embodiment of a preform or container generally illustrated in FIG. 17B.

FIG. 17B is a front view of a neck finish portion of an embodiment of a preform or container. FIG. 17C is a sectional view of the neck finish portion shown in FIG. 17B.

Figure 18:
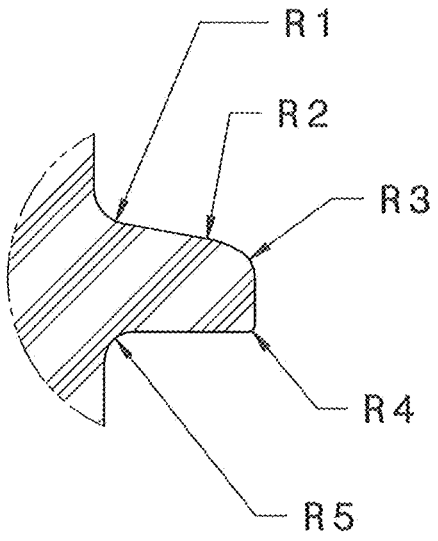
FIG. 18 is a partial sectional view of a neck finish portion of an embodiment of a preform or container, such as illustrated in FIG. 16.
Figure 19:
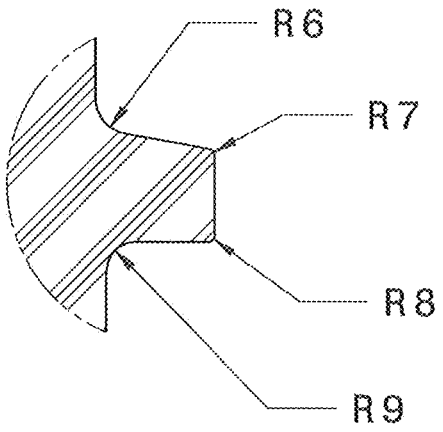
FIG. 19 is a partial sectional view of a neck finish portion of an embodiment of a preform or container, such as illustrated in FIG. 16.

FIG. 18 and FIG. 19 are partial sectional views of a neck finish portions of an embodiment of a preform or container, such as illustrated in FIG. 16. FIGS. 18 and 19 illustrate, inter alia, various radii associated with a tamper evident band at rachet full extension (FIG. 18) and at ratchet root diameter (FIG. 19). By way of example and without limitation, an embodiment of the illustrated radii may have the following dimensions: R1—0.010 in. (0.25 mm); R2—0.26 in. (0.65 mm); R3—0.008 in. (0.20 mm); R4—0.002 in. (0.05 mm); R5—0.008 in. (0.20 mm); R6—0.010 in. (0.25 mm); R7—0.002 in. (0.05 mm); R8—0.002 in. (0.05 mm); and R9—0.008 in. (0.20 mm).

Embodiments of the disclosed closure 10 may be used in connection with containers having neck portions that have single lead threads, double lead threads, or triple lead threads. As those of skill in the art will appreciate, degree of turning of a cap to provide an associated lift to separate the cap from the tamper evident band for a single lead thread will be greater than the degree of turning of a cap associated with a double lead thread, which will further be greater than the degree of turning associated with a triple lead thread. For example and without limitation, a 120° turn of a cap may provide sufficient lift (or lift range) for a triple lead thread.

In embodiments that involve a comparatively short cap, such as may be applicable for non-carbonated contents, such as water, the amount of required lift to separate the cap may be comparatively small.

Embodiments of the present disclosure can provide a closure 10 that is suitable for use with carbonated and non-carbonated contents (e.g., water). Generally, the threads associated with a plastic container may differ depending on whether the container is intended to hold contents under pressure (e.g., contents that are carbonated).

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are intended to be inclusive unless such a construction would be illogical.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

It is intended that all matter contained in the above description or shown in the accompanying drawings shall be interpreted as illustrative only and not limiting. Changes in detail or structure may be made without departing from the present disclosure.

What is claimed is:

1. A tethered plastic closure, comprising:

a cap including internal threads;

a tamper evident band having a vertical height between about 1 mm and about 4 mm around a majority of a circumference of the closure;

a plurality of breakaway connectors disposed substantially around the circumference of the closure and connecting the tamper evident band and the cap, wherein the plurality of breakaway connectors break away between the tamper evident band and the cap; and a connecting portion connecting the tamper evident band and the cap, the connecting portion maintaining the connection of the cap and the tamper evident band after separation of the plurality of breakaway connectors from the cap;

wherein a ratio of a vertical distance between the cap and the tamper evident band in which the plurality of breakaway connectors are disposed and the vertical height of the tamper evident band is about 0.10 or less.

2. The tethered plastic closure according to claim 1, wherein the connecting portion has a tear-off resistance in a vertical and a horizontal direction of at least 7 N.

3. The tethered plastic closure according to claim 1, wherein the connecting portion has a tear-off resistance in a vertical and a horizontal direction of at least 25 N.

4. The tethered plastic closure according to claim 1, wherein a thickness of the connecting portion is greatest at a circumferential mid-point of the connecting portion.

5. The tethered plastic closure according to claim 1, wherein a circumferential distance of the connecting portion is at least two times a horizontal dimension of an individual breakaway connector.

6. The tethered plastic closure according to claim 1, wherein the plurality of breakaway connectors comprise more than two breakaway connectors and the more than two breakaway connectors are equidistantly spaced circumferentially.

7. The tethered plastic closure according to claim 1, wherein the internal threads comprise triple lead threads.

8. The tethered plastic closure according to claim 1, wherein a circumferential distance of the connecting portion is greater than or equal to the vertical height of the tamper evident band.

9. The tethered plastic closure according to claim 1, wherein an associated angle of the connecting portion about a vertical centerline of the cap is in a range of about 5° to about 45°.

10. A container assembly, comprising:
a plastic container; and
a tethered plastic closure, comprising:
a cap including internal threads;
a tamper evident band having a vertical height of about 3 mm or less around a majority of a circumference of the closure;
a plurality of breakaway connectors disposed substantially around the circumference of the closure and connecting the tamper evident band and the cap, wherein the plurality of breakaway connectors break away between the tamper evident band and the cap; and
a connecting portion connecting the tamper evident band and the cap, the connecting portion maintaining the connection of the cap to the tamper evident band after separation of the plurality of breakaway connectors from the cap;
wherein a ratio of a vertical distance between the cap and the tamper evident band in which the breakaway connectors are disposed and the vertical height of the tamper evident band is about 0.10 or less; and an associated angle of the connecting portion about a vertical centerline of the cap is in a range of about 5° to about 45°.

11. The container assembly according to claim 10, wherein the plastic container includes a neck finish that comprises external threads configured to engage with the internal threads of the cap.

12. The container assembly according to claim 11, wherein the threads comprise triple lead threads.

13. The container assembly according to claim 10, wherein the connecting portion has a tear-off resistance in a vertical and a horizontal direction of at least 7 N.

14. The container assembly according to claim 10, wherein the connecting portion has a tear-off resistance in a vertical and a horizontal direction of at least 25 N.

15. The container assembly according to claim 10, wherein a circumferential distance of the connecting portion is at least two times a horizontal dimension of an individual breakaway connector.

16. The container assembly according to claim 10, wherein a thickness of the connecting portion is greatest at a circumferential mid-point of the connecting portion.

17. The container assembly according to claim 10, wherein the vertical height of the tamper evident band is at least 1 mm.

18. The container assembly according to claim 10, wherein the plurality of breakaway connectors are equidistantly spaced.

19. The container assembly according to claim 10, wherein a thickness of the connecting portion varies along a length of the connecting portion.

20. The container assembly according to claim 10, wherein an associated angle of the connecting portion about a vertical centerline of the cap is between about 5° and about 30°.

21. A container assembly, comprising:
a plastic container; and
a tethered plastic closure, comprising:
a cap including internal threads;
a tamper evident band having a vertical height between about 1 mm and 3 mm around a majority of a circumference of the closure;
a plurality of breakaway connectors disposed substantially around the circumference of the closure and connecting the tamper evident band and the cap, wherein the plurality of breakaway connectors break away between the tamper evident band and the cap; and
a connecting portion connecting the tamper evident band and the cap, the connecting portion maintaining the connection of the cap to the tamper evident band after separation of the plurality of breakaway connectors from the cap;
wherein a ratio of a vertical distance between the cap and the tamper evident band in which the plurality of breakaway connectors are disposed and the vertical height of the tamper evident band is about 0.10 or less; and a circumferential distance of the connecting portion is at least two times a horizontal dimension of an individual breakaway connector.

22. The container assembly according to claim 21, wherein a vertical distance from an upper surface of a support flange to a lower surface of a tamper evident formation of the plastic container is equal to or greater than the vertical height of the tamper evident band.

23. The container assembly according to claim 21, wherein a portion of the tamper evident band below the connecting portion includes one or more portions with material added or removed.

24. The container assembly according to claim 21, wherein a thickness of the connecting portion is greatest at a circumferential mid-point of the connecting portion.

25. The tethered plastic closure according to claim 1, wherein the plurality of breakaway connectors comprise at least five separated breakaway connectors.

26. The tethered plastic closure according to claim 1, wherein the plurality of breakaway connectors comprise at least fourteen separated breakaway connectors.

27. The tethered plastic closure according to claim 1, wherein the plurality of breakaway connectors are separately spaced around a majority of a circumference of the closure.

28. The tethered plastic closure according to claim 1, wherein the tamper evident band has a vertical height between 2.25 mm and 1 mm.

29. The tethered plastic closure according to claim 1, wherein the ratio of the vertical height of the tamper evident band to a closure height is about 0.184 or less.

30. The tethered plastic closure according to claim 1, wherein the ratio of the vertical height of the tamper evident band and the vertical distance between the cap and the tamper evident band in which the plurality of breakaway connectors are disposed to a closure height is about 0.25 or less.

31. The tethered plastic closure according to claim 1, wherein the ratio of the vertical height of the tamper evident band and the vertical distance between the cap and the tamper evident band in which the plurality of breakaway connectors are disposed to a closure height is about 0.20 or less.

32. The tethered plastic closure according to claim 1, wherein the connecting portion extends a circumferential distance around the closure about 1.13 mm (0.0445 inches) or less.

* * * * *